US009375096B2

(12) United States Patent
Larch

(10) Patent No.: US 9,375,096 B2
(45) **Date of Patent: *Jun. 28, 2016**

(54) CARRYING DEVICE FOR A BABY OR SMALL CHILD

(71) Applicant: Daniela Larch, Ramsau (AT)

(72) Inventor: Daniela Larch, Ramsau (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/812,320

(22) Filed: Jul. 29, 2015

(65) Prior Publication Data

US 2015/0327688 A1 Nov. 19, 2015

Related U.S. Application Data

(63) Continuation of application No. 13/390,368, filed as application No. PCT/AT2010/000294 on Aug. 11, 2010, now Pat. No. 9,138,071.

(30) Foreign Application Priority Data

| | | |
|---|---|---|
| Aug. 14, 2009 | (AT) | A 1282/2009 |
| Feb. 23, 2010 | (AT) | A 272/2010 |
| Jun. 18, 2010 | (AT) | A 1009/2010 |

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025; A61G 1/00
USPC ..... 224/159–161
See application file for complete search history.

(56) References Cited

U.S. PATENT DOCUMENTS

| | | | |
|---|---|---|---|
| 3,780,919 | A | 12/1973 | Hansson |
| 4,009,808 | A | 3/1977 | Sharp |
| 4,469,256 | A | 9/1984 | McEwen |
| 5,678,739 | A | 10/1997 | Darling et al. |
| 6,409,060 | B2 | 6/2002 | Donine |
| 7,770,765 | B2 | 8/2010 | Stevens et al. |
| 8,403,189 | B2 | 3/2013 | Nyberg et al. |
| 2003/0192925 | A1 | 10/2003 | Boone |
| 2005/0077331 | A1 | 4/2005 | Keller et al. |
| 2005/0218168 | A1 | 10/2005 | Chua |
| 2009/0026235 | A1 | 1/2009 | Gray |
| 2011/0163136 | A1 | 7/2011 | Billingham |
| 2011/0290831 | A1 | 12/2011 | Wang |

FOREIGN PATENT DOCUMENTS

| | | | |
|---|---|---|---|
| CN | 2674964 | Y | 2/2005 |
| CN | 1976610 | A | 6/2007 |
| JP | 2006192221 | A | 7/2006 |
| JP | 2007111092 | A | 5/2007 |

*Primary Examiner* — Corey Skurdal

(74) *Attorney, Agent, or Firm* — Laurence A. Greenberg; Werner H. Stemer; Ralph E. Locher

(57) ABSTRACT

A carrying device for a baby or a small child has a retaining harness system and an accommodating element connected to the retaining harness system. At least one end area of the accommodating element extends at least to the retaining harness system and is adjustably connected to the retaining harness system. An accommodation space of the accommodating element can be adapted to the size of the baby or small child to be carried.

7 Claims, 4 Drawing Sheets

CARRYING DEVICE FOR A BABY OR SMALL CHILD

CROSS-REFERENCE TO RELATED APPLICATION

This application is a continuation of copending patent application Ser. No. 13/390,368, filed Mar. 9, 2012, which was a §371 national stage application of international patent application PCT/AT2010/000294, filed Aug. 11, 2010; this application also claims the priority, under 35 U.S.C. §119(a), of Austrian patent applications Nos. A 1282/2009, filed Aug. 14, 2009, A 272/2010, filed Feb. 23, 2010, and A 1009/2010, filed Jun. 18, 2010; the prior applications are herewith incorporated by reference in their entirety.

BACKGROUND OF THE INVENTION

Field of the Invention

The present invention relates to a carrying device for a baby or small child, with a retaining harness system and with an accommodating element connected to the retaining harness system, wherein the retaining harness system has two shoulder straps, and the accommodating element defines the accommodating space for the baby or small child to be carried, between the shoulder straps.

For example U.S. Pat. No. 5,678,739 shows a carrying device of this kind, which has a shoulder strap system with two shoulder straps. An accommodating element which can be shaped around the child is adjustably fixed hereto using straps. The accommodating element forms a shell which cannot grow with the child. Only the length of the straps is adjustable and the bigger the child becomes, the wider the gap to the shoulder straps on each side. However, the widening of the gap has an adverse effect on the initial carrying comfort for carrier and child. In addition to or instead of the carrying element a sling, thus a wrap, can also be suspended from the clasps or buckles of the shoulder strap system. From US 2009/0026235 another similar carrying device is known, which also has the above-mentioned disadvantage that the accommodating element does not grow with the child. In addition, with these carrying devices the accommodating element is not evenly tensioned and consequently the baby or child is not evenly supported. By contrast, slings provide ideal support for the child and constantly adapt to its growing body but have the disadvantage that they are very awkward to tie.

BRIEF SUMMARY OF THE INVENTION

The object of the invention is now to retain the wrapping of the growing small child/baby in the case of adjustment of the accommodating element, and to avoid the widening gap to the retaining harness system in spite of the growth in size of the small child/baby, at least on one side. According to the invention this is achieved in that the accommodating element extends with at least one end area at least to the retaining harness system and is adjustably connected thereto, whereby the size of the accommodating space can be adapted to the size of the baby or small child to be carried.

One or two end areas protruding over the retaining harness system can be pulled in to enlarge the central area and accommodate the increasing size of the child: the accommodating space thus grows with it. Consequently babies are carried orthopaedically correctly in various carrying positions from birth onwards into childhood. The baby or child is wrapped in and evenly supported by the evenly tensioned accommodating element and by the even pressure, and an orthopaedically correct spread-squat position is made possible. The baby or small child can be carried with its face or back towards the carrier's body, wherein carrying is possible on the carrier's back, chest or side (in this case the two shoulder straps cross over one another on one of the carrier's shoulders). Handling is simple, use is secure and comfortable for the carrier. In a recumbent position the baby can be carried in the accommodating element for instance as in a sling or wrap.

In order to make connection possible, at least one connection element, for example one or more rings, can be arranged on the retaining harness system. The connection elements can be positioned detachably or non-detachably for instance on the shoulder straps, for example at their upper and/or lower ends, or for instance on a connecting strap between the shoulder straps or for instance on a connecting strap between shoulder straps and hip belt.

Moreover, the retaining harness system can additionally be connected to the accommodating element, wherein adaptation to the body measurements of the accommodated child is advantageously possible. One or more additional connections of the accommodating element to the retaining harness system can advantageously be designed such that the accommodating element or accommodating space is held in a certain position with respect to height and cannot slip downwards, with the result that the upper back of the baby or small child is additionally supported or the baby or child is prevented from tipping backwards out of the carrying device. In a preferred embodiment two upper and two lower connections are provided between the accommodating element and the retaining harness system, and the accommodating element is adjustably connected to at least one of the two lower connections. An additional adjustment at the upper connections is possible.

However, the accommodating element can also be adjustably connected to the retaining harness system without connection elements, for instance by guiding one or two end areas of the accommodating element behind the retaining harness system, for instance behind the shoulder straps and/or behind the connecting strap between the shoulder straps or between the shoulder straps and the hip belt. The position and size of the accommodating space can be changed by pulling on the end areas protruding beyond the retaining harness system or the shoulder straps.

However, the accommodating element can also be non-adjustably connected to the retaining harness system with an end area, wherein adaptation to the accommodated body then takes place via the adjustable connection between the other end area and the retaining harness system.

Connection elements on the retaining harness system advantageously have a clamping function, whereby in particular the position or size of the accommodating space or the adjusted wrapping of the child is held. In a further preferred embodiment the connection with which the accommodating element is adjustably connected is formed by a pair of rings through which the end area of the accommodating element is guided and movably clamped. For this purpose, the end area of the accommodating element is guided through both rings, then the end area is folded back and guided through the first of the two rings again. The position and size of the accommodating space determined by the central area of the accommodating element can be changed by pulling on the end area protruding from the rings. The rings are advantageously at least partially concealed by the end area of the accommodating element, with the result that the baby or child cannot be pinched in them and the rings do not press against the carrier's body. The rings can also have shapes other than round, and can be divided by bars. Furthermore, the connection elements can also be opened and closed similarly to a snap closure or carabiner and can thus be guided for instance through tabs on the shoulder straps and closed. However, clamping closures or tri-glide buckles with at least one bar, wherein the bar can be movable, for example also come into consideration as connection elements.

In a preferred embodiment it is moreover provided that at least one connection is adjustably arranged on the retaining harness system. The length of the shoulder straps is advantageously adaptable to the body measurements of the carrier. For this, adjustment elements or fastening devices can for example be provided or the shoulder straps are for instance tied around the body of the carrier. If the shoulder straps do not cross over each other, they can advantageously be detachably connected to each other, for instance by means of a so-called chest strap, and thus prevented from slipping off the shoulders. Any connections between the shoulder straps are advantageously adaptable to the body measurements of the carrier and according to one design slidable on the shoulder strap. However, according to one design connection elements, for example rings, for instance in each case on both shoulder straps and on the side of the body opposite the accommodating element, can also be additionally connected to each other, wherein this connection can also advantageously be adapted to the body measurements of the carrier.

The accommodating element can for example comprise one or more parts or one or more layers, wherein several parts can for example be detachably connected for instance by means of fastening devices, can have openings for the legs and/or arms of the baby or child, can for instance have darts and can for instance be pleated in particular at the end areas. The end areas can taper for instance because of the pleating or darts or because of the cut or else also become wider towards the end. The accommodating element can be wholly or partially formed of material, cloth, padding, cushion or netting or be wholly or partially padded (for instance by means of foam) or reinforced.

The accommodating space can however also be reinforced such that it cannot be folded or gathered, in particular in the area of the child's back or spine, but is somewhat rigid or only bendable. This reinforcement has the advantage that the back area of the accommodated child is additionally supported. The reinforcement can cover the entire width or only partially cover the width of the accommodating element. At least one end area of the accommodating element, in particular made from a textile material, can in any case essentially be folded or gathered.

The size (length and/or width) of the accommodating element can also be adjustable: if one or more fastening devices on the accommodating element are connected to each other, the accommodating element is made smaller. At least two positions or sizes are possible. However, with respect to the width and/or length the accommodating element can also be folded once or more times and thus made smaller and so connected to the retaining harness system.

Markings can be provided on the accommodating element, which make it possible for the end areas of the accommodating element protruding from the connection elements or beyond the retaining harness system to be adjusted for instance to an equal length.

An essential advantage is that the baby or child can be accommodated substantially more simply than in a sling: in contrast to a sling, the carrier advantageously first adapts the retaining harness system to his body measurements, connects the accommodating element to the retaining harness system if not already connected, and only then accommodates the baby or child in the accommodating element. They then only need to adapt the accommodating space to the accommodated body. After adaptation, the bag-like accommodating space corresponds precisely to the body measurements of the accommodated body. If the accommodating element was clamped by the connection elements, there is also no need for the accommodating element to be re-adapted every time it is put on again, but it can be used again in the adjusted position.

One or two end areas of the accommodating element protruding from the connections or beyond the retaining harness system, for instance shoulder straps, can, in particular depending on their length, be continued in a variety of ways; for example they can simply hang down (provided that the position of the accommodating space is securely held, for instance by clamping), be stowed in a bag or under a hip belt, if there is one, or be connected to each other or to the shoulder straps.

One or two end areas of the accommodating element protruding from the connections or beyond the retaining harness system, for instance shoulder straps, can, if suitably long, be guided under the baby's bottom and/or legs and/or crossing over the accommodating element, wherein they are preferably pulled through one or more tabs or loops. These tabs/loops are positioned such that the accommodating element is held in a certain position with respect to height, and cannot slip downwards, with the result that the upper back of the baby or small child is additionally supported or the child/baby is prevented from tipping backwards out of the carrying device, and/or positioned such that the baby cannot fall downwards out of the carrying device. These tabs can be designed to open and to close. Openings for pulling the end areas through can also be provided on the accommodating element.

Furthermore, a hip belt system, which optionally has padded sections and can be connected to a retaining harness system with the shoulder strap system, can be detachably or non-detachably connected to the accommodating element. For this, fastening devices, for instance zip fasteners or Velcro strips, which can be connected to each other can be provided on the hip belt system as well as on the accommodating element.

Due to the positioning of the hip belt system and/or the additional connections to the retaining harness system on the accommodating element, one or two surplus areas, which can be folded back or folded together, can arise at the top and/or bottom of the accommodating space. The end areas are thus wider than the accommodating space tensioned around the baby/child. The accommodating space tensioned around the baby/child is thus advantageously only so wide that at least part of the back of the child/baby can be wrapped. However, the end areas are so wide that the wrapping reaches to the back of its knees.

The present carrying device can moreover be provided with a head part which supports the head, neck, or upper back of the baby or child accommodated against the carrier's upper body or can serve as a sunshade. The head part thus serves as an upper extension and can for example be gathered by elastic strips. The length and/or the tightening of the head part is advantageously adjustable. The head part can be detachably or non-detachably connected to the shoulder straps and/or the accommodating element or can be positioned between the retaining harness system or shoulder straps and accommodating element.

If the accommodating element is detachably connected to the retaining harness system, the accommodating element separated from the retaining harness system can also be used as a sling or, if the accommodating element is connected with rings, used as a so-called "ring sling."

Individual parts of the carrying device can for example be detachably connected by tying together or for instance by closure devices of a side-release buckle type. However, other connection possibilities are also conceivable, for instance press studs, Velcro fasteners, zip fasteners, which can be covered by covering means or can be padded and thus cause no pressure points on the accommodated baby or child or on the carrier. In particular the connection elements for connecting the accommodating element to the retaining harness system can be concealed such that the accommodated baby or child cannot be pinched in them. Closure devices of the side-release buckle type are advantageously formed with adjusting devices.

Further details, features and advantages of the invention are apparent from the following description of embodiment examples with reference to the drawings.

DESCRIPTION OF THE INVENTION

Hereafter the same reference numbers refer to the same or similar components. The use of closing elements is by way of example, as is their spatial arrangement.

Figure 1:
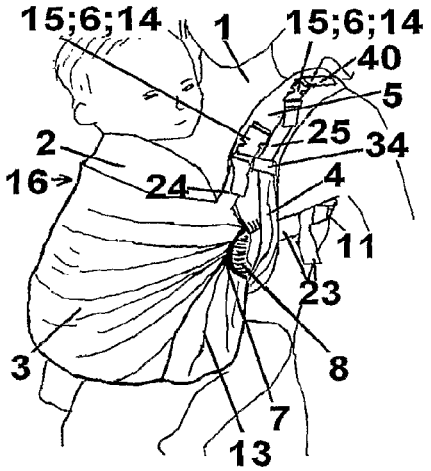
FIG. 1 shows a carrying method for a first embodiment of the carrying device according to the invention, the small child is carried on the carrier's chest.

FIG. 1 shows a carrying method for a first embodiment of the carrying device according to the invention. This example shows the accommodation of a small child 2, which is carried with its chest towards the chest of the carrier 1. Padded shoulder straps 5 each pass over one shoulder of the carrier 1. Both the front and the rear shoulder strap ends 5 are non-detachably connected to rings 7, 8 and thus form a loop: a strap 23 is adjustably connected to the rings 7, 8 and to the adjustment element 11 positioned on the rear shoulder strap end 5. By means of adjustment element 11 the strap 23 and thus the length of the shoulder straps 5 can be adapted to the body measurements of the carrier 1 and the ideal position of the rings 7, 8 adjusted at the side of the carrier 1. An accommodating element 16 has been connected to the shoulder straps 5 by means of the strap 24 connected to the accommodating element 16 and with side release buckle portions 15 (positioned on the strap 24) and 6 (positioned on the shoulder strap 5), wherein with an adjustment element 14 formed in a single piece with the side release buckle part 15 a strap 24 is adapted to the body measurements of the accommodated small child 2. By this additional connection of the accommodating element 16 to the shoulder straps 5 the accommodating space 3 is additionally held in the adjusted position with respect to height and in particular the accommodating space 3 is thereby prevented from slipping downwards and the small child 2 is prevented from tipping backwards or falling backwards out of the carrying device. Each end area 4, 13 of the accommodating element 16 passes through both rings 7, 8 on the respective shoulder strap 5 and then through the first ring 7 again, wherein it is clamped between the rings 7, 8 and can be tightened. In this embodiment example the end areas 13, 4 of the accommodating element 16 taper towards the end and are moreover pleated. They are connected to straps 25. The end area 13 passes under the bottom of the small child 2, is concealed by the small child in this figure, is guided through a tab 41 (FIG. 2) and crosses over the end area 4. Furthermore, the end area 13 is guided through a tab 34 on the other shoulder strap 5 (here concealed by the small child 2) and connected to the other shoulder strap 5 by means of side release buckle portions 15 (positioned on the strap 25) and 6 (positioned on the shoulder strap 5). The strap 25 is adapted to the body measurements of the small child 2 with the adjustment element 14 formed in a single piece with the side release buckle 15. The second end area 4 of the accommodating element 16, which in FIG. 1 is concealed by the small child 2, is guided through the rings 7, 8 located on the other, non-visible shoulder strap 5 and then through the ring 7 again and clamped between the rings. The protruding end area 4 passes under the bottom of the small child 2, crossing over the first end area 13 through the tab 41 (FIG. 2) and through the tab 34 and is connected to the visible shoulder strap 5 by means of strap 25 positioned on the end area 4 and side release buckle portions 15 (positioned on the strap 25) and 6 (positioned on the shoulder strap 5). By means of an adjustment element 14 formed in a single piece with the side release buckle part 15 the strap 25 can be adapted to the body measurements of the accommodated small child 2. The strap 40 can be folded with the side release buckle portion 6 onto the other side of the shoulder strap 5. The two end areas 4, 13 can also be guided around the hips of the carrier 1 and detachably connected to each other, can hang down or can be stowed in a pouch. The accommodating space 3 has been smoothly adapted to the body measurements of the small child 2 and the wrapping corresponds precisely to the body measurements of the small child 2. As in the case of the sling, the accommodating space 3 passes from the back of one knee to the back of the other and the correct spread-squat position is thereby guaranteed.

Figure 2:
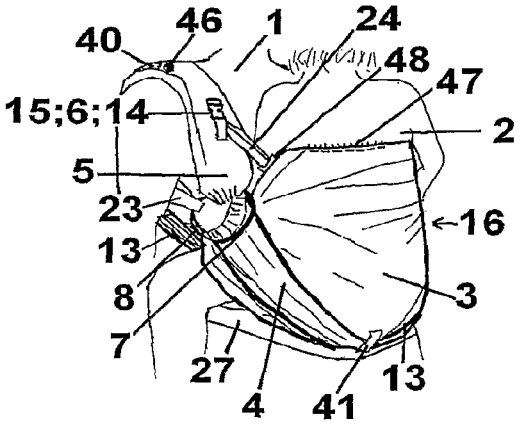
FIG. 2 shows a carrying method for a second embodiment, the small child is carried on the carrier's back.

FIG. 2 shows a carrying method in which the small child 2 is carried on the back of the carrier 1. The end area 4 is guided through the rings 7, 8 and then through the first ring 7 again. The end area 4 is furthermore guided under the bottom of the small child 2, passes through the tab 41, crossing over the other end area 13. The strap 24 is attached to the shoulder strap 5. The side release buckle part 15 positioned on the strap 24 and the adjustment element 14 formed in a single piece therewith and the strap 24 are guided through a connection element 48 and connected to the side release buckle part 6 on the shoulder strap 5, with the result that the accommodating element 16 is connected to the shoulder straps 5 and the height of the accommodating element 16 or of the accommodating space 3 is fixed and cannot slip downwards and the small child 2 cannot fall backwards out of the carrying device. The adaptation of the strap 24 to the body measurements of the accommodated small child 2 is carried out with the adjustment element 14 formed in a single piece with the side release buckle part 15. The strap 23 is connected to the adjustment element 11 positioned on the lower shoulder strap end 5 and not visible here (FIG. 1) and to the rings 7, 8 and has been adapted by means of adjustment element 11, not visible here, to the body measurements of the carrier 1. The end area 13, not visible here, is guided through the rings 7, 8 positioned on the other shoulder strap 5 and through the ring 7 again, through the tab 41, crossing over the first end area 4 and under the bottom of the small child 2. The accommodating space 3 has been adapted to the body measurements of the small child by pulling on the end areas 4, 13 protruding from the rings 7, 8 and the wrapping corresponds precisely to the body measurements of the small child 2. The strap 40 is positioned on the shoulder strap 5 and the side release buckle parts 6 arranged on the straps 40 are folded from the front of the shoulder straps 5 (as depicted in FIG. 1) with the strap 40 onto the back of the shoulder straps 5 and connected to the side release buckle parts 15 on the end area 13 or 4 (visible in FIG. 3). The accommodating element 16 is furthermore detachably connected to a hip belt 27 by means of a zip fastener. A zip fastener 47 can be provided on the accommodating element 16 and press studs 46 on the shoulder straps 5 for attaching a head part. The head part can be gathered or tensioned.

Figure 3:
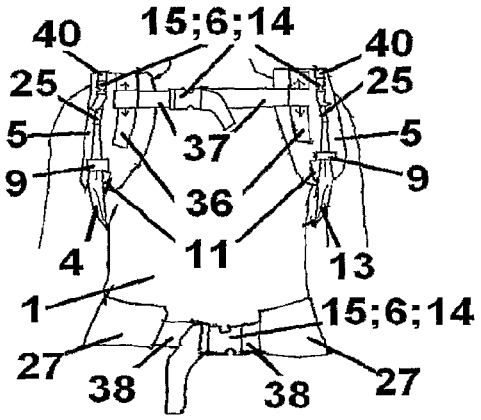
FIG. 3 shows a view of the chest of the carrier in FIG. 2.

FIG. 3 shows a front view of the chest of the carrier carrying the child on their back (FIG. 2). The padded hip belt 27 is closed by means of side release buckle portions 15, 6 and the length of the strap 38 positioned on the hip belt 27 and connected to the side release buckle portions 15, 6 is adapted to the body measurements of the carrier 1 by means of an adjustment element 14. The end areas 4, 13 or the straps 25 attached to the end areas 4, 13 are guided through the tabs 9 and connected to the shoulder straps 5 via the side release buckle portions 15, 6. The adaptation of the strap 25 to the body measurements of the small child 2 is carried out with the adjustment element 14 which is formed in a single piece with the side release buckle part 15. The shoulder straps 5 are connected by means of a chest strap 37 movable on the straps 36 (strap 36 is positioned on the shoulder straps 5). The chest strap 37 also has an adjustable side release buckle 15, 6 and the strap 37 can be adapted to the body measurements of the carrier with the adjustment element 14. The optimum position of the rings, namely advantageously at the carrier's side, is supported by the chest strap 37. However, instead of the shoulder straps, the chest strap 37 can also connect the pairs of rings 7, 8, not visible here, wherein the chest strap 37 in this carrying variant passes over the chest of the carrier 1. If the small child 2 is carried on the chest of the carrier 1, the chest strap 37 passes over the back.

Figure 4:
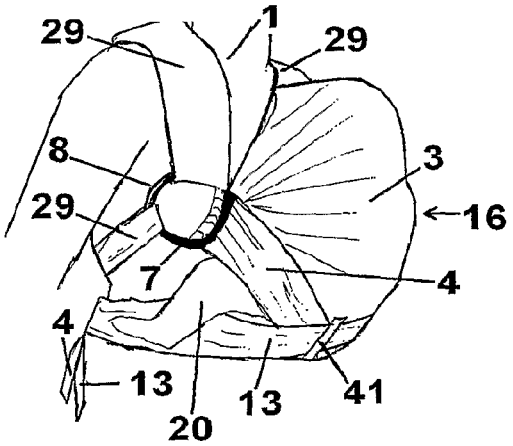
FIG. 4 shows a third embodiment, which has been tied around the body of the carrier and around the body of the baby.
Figure 5:
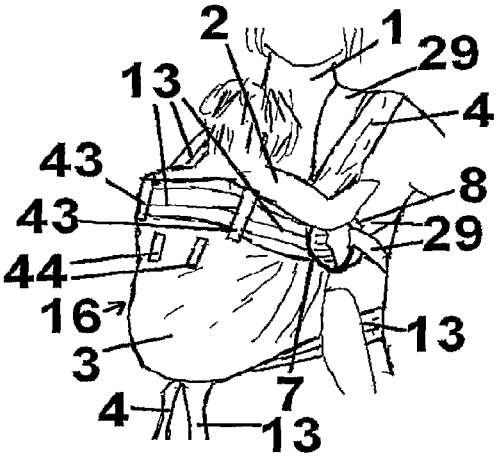
FIG. 5 shows a fourth embodiment, which has been tied around the body of the carrier and around the body of the small child.

FIGS. 4 and 5 show embodiments in which the carrying device has no side release buckles, but is put on by tying around the body of the carrier 1 and of the baby 20 or small child 2. The rings 7, 8 through which the rear shoulder strap ends 29 are guided after being crossed over at the back, are located on the front shoulder strap ends 29. In the embodiment examples according to FIG. 4 and FIG. 5 the rear shoulder strap ends 29 pass back again to the back and are there connected to each other. The shoulder strap ends 29 could however also cross over each other again there and continue to the front, where they are connected to each other at the side or on the chest of the carrier 1. The end areas 4, 13 are guided through the rings 7, 8 and then through the first ring 7 again, through the tab 41 and under the bottom and the legs of the baby 20 and around the hips of the carrier 1. The end areas 4, 13 cross each other under the bottom of the baby 20 and are knotted together on the back of the carrier 1. As a result the baby 20 cannot slip downwards out of the carrying device. The wrapping of the baby 20 by the accommodating space 3 corresponds precisely to the body measurements of the baby 20. This embodiment can also be used for carrying on the back or side of the carrier 1. In the case of carrying on the side, the shoulder strap ends 29 can cross over one shoulder of the carrier 1, wherein the rings 7, 8 are located on the back and on the chest of the carrier 1.

In the embodiment according to FIG. 5 the end areas 13, 4 of the accommodating element 16 pass transversely over the accommodating space 3 and through the tabs 43, subsequently over the shoulder, crossing over the back and around the hips of the carrier 1, where they are connected to each other. They are guided through a tab 41, not visible in FIG. 5, on the accommodating element 16 under the bottom of the small child 2, with the result that the small child 2 cannot slip through between the accommodating space 3 and the end areas 4, 13. For a smaller child 2 the end areas 4, 13 can be guided, not through the tabs 43, but through the tabs 44 provided lower down. Guiding the end areas 4, 13 through the tabs 43 or 44 keeps the accommodating space 3 in this position with respect to height, as a result of which the small child 2 cannot tip or fall backwards out of the carrying device. This embodiment can also be used for carrying on the back or side of the carrier 1.

Figure 6:
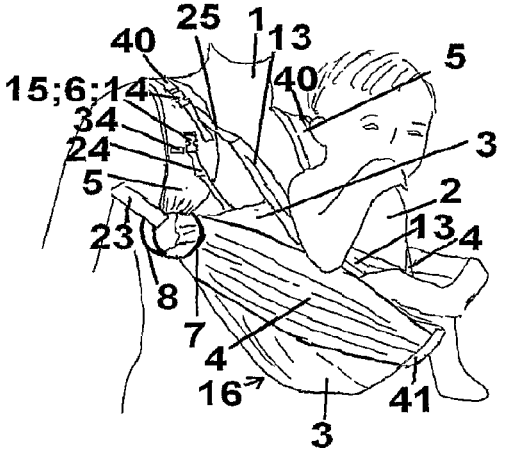
FIG. 6 shows a second carrying method for the embodiment according to FIG. 1, wherein the small child is carried with its back to the carrier.

FIG. 6 shows a further carrying method, in which the small child 2 sits in front of the carrier 1 in the accommodating space 3. The end areas 4, 13 are in each case guided through the rings 7, 8 and then through the first ring 7 again and subsequently through the tab 41, crossing over on the body of the small child 2 and under the arms of the small child 2 and connected to the shoulder straps 5 by means of the side release buckle portions 15, 6, wherein the straps 25 positioned at the end of the end areas 4,13 can be adapted to the body measurements of the small child by means of the adjustment elements 14 formed in a single piece with the side release buckle portions 15. In this embodiment example the end areas 4, 13 or the straps 25 were not guided through the tabs 34. The accommodating element 16 has been connected to the shoulder straps 5 by means of closing elements 15, 6, the strap 24 has been adapted to the body measurements of the small child 2 by means of adjustment element 14. The legs of the small child 2 can also be located in the accommodating space 3. Accommodation, in particular of a baby or very small child 2, in a substantially recumbent position is also possible with this variant.

Figure 7:
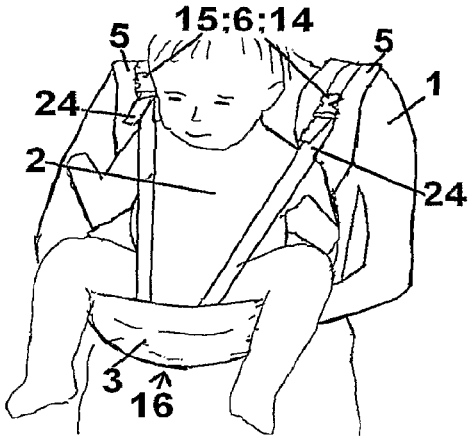
FIG. 7 shows a further carrying method for a further embodiment wherein the small child is carried with its back to the carrier.

FIG. 7 shows a further embodiment of the carrying device according to the invention. The end areas 13, 4 have in each case been guided through the rings 7, 8, not visible here, and then through the first ring 7 again. The small child 2 sits in the accommodating space 3 with its back to the chest of the carrier 1. The accommodating space 3 reaches from the back of one of the knees of the small child 2 to the other, and thus the orthopaedically correct spread-squat position is also guaranteed in this position. The straps 24 attached to the accommodating element 16 have been guided over the body of the small child 2 and connected to the shoulder straps 5 with the side release buckle portions 15, which are connected to the strap 24, and the side release buckle portions 6, which are positioned on the shoulder strap 5. With the adjustment elements 14 formed in a single piece with the side release buckle portions 15 the straps 24 are adapted to the body measurements of the small child 2. The legs of the small child 2 can also be located between the straps 24 or in the accommodating space 3. Accommodation, in particular of a baby or very small child, in a substantially recumbent position is also possible with this variant.

Figure 8:
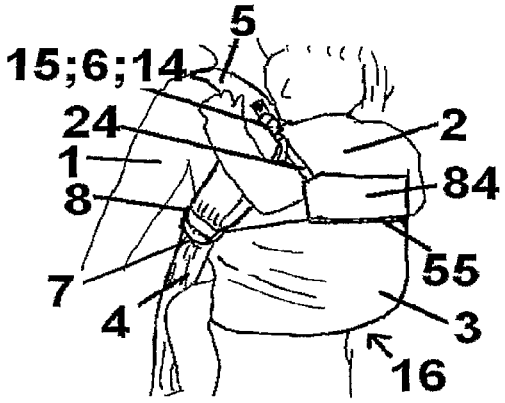
FIG. 8 shows a further embodiment, in which the upper back of the small child is supported by a free part.

FIG. 8 shows a further embodiment of the carrying device according to the invention. The accommodated small child 2 is wrapped in the accommodating space 3 from the backs of its knees to for instance the middle of its back, its upper back is supported by the free part 84 which is connected to the upper area of the accommodating space 3, but not to the end areas 4, 13 of the accommodating element 16. Straps 24 positioned on the free part 84 are connected to the side release buckle portions 6 on the shoulder straps by means of side release buckle portions 15 positioned on the strap 24 and adapted to the body measurements of the small child 2 by means of adjustment elements 14. The end areas 4, 13 have been guided through the rings 7, 8, then folded back and guided through the first of the two rings 7 again and thus movably clamped by the rings. The accommodating element 16 is adjustably connected to the shoulder straps 5 and grows with the small child 2. The free part 84 allows the small child 2 freedom of arm movement. If the closed zip fastener 55 is opened, the free part 84 is expanded. The free part 84 can however also be non-detachably connected to the shoulder straps 5.

Figure 9:
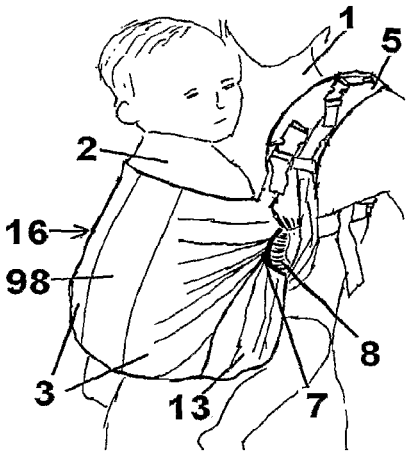
FIG. 9 shows a further embodiment, in which the accommodating space is reinforced.

In FIG. 9 a hard shell 98 is attached to the accommodating space 3 and the accommodating space 3 is thereby reinforced such that it cannot be folded or gathered, but only bent slightly. By contrast, the end areas 13, 4 can be folded or gathered and have been guided through the rings 7, 8, folded back and guided through the first ring 7 again, whereby the end areas 13, 4 are movably clamped.

Figure 10:
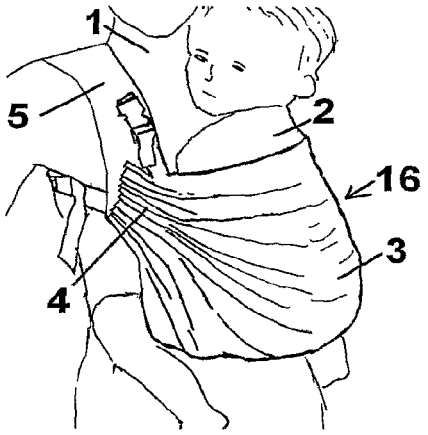
FIG. 10 shows a further embodiment, in which one end area of the accommodating element is non-adjustably connected to the retaining harness system.

FIG. 10 shows an embodiment example, in which the accommodating element 16 is non-adjustably connected with its end area 4 to the shoulder strap 5 visible here. The end area 4 of the accommodating element 16 has been pleated several times and thus non-detachably and non-adjustably connected to the shoulder strap 5. The adaptation of the accommodating space 3 to the body of the small child 2 is carried out by the adjustable connection, not visible here, of the other end area 13 to the rings 7, 8, not visible here, provided on the other shoulder strap 5 (FIG. 11).

Figure 11:
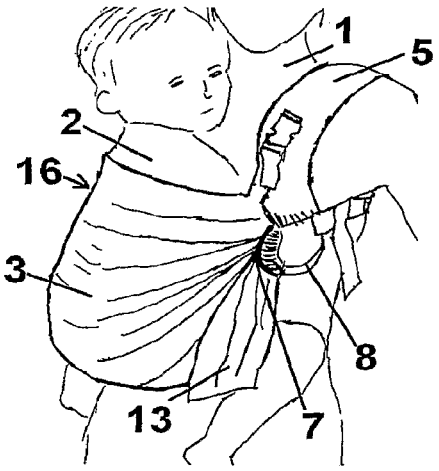
FIG. 11 shows a second view of the carrying method and embodiment in FIG. 10.

FIG. 11 shows a second view of the embodiment example described in FIG. 10. Here it can now be seen how the end area 13 of the accommodating element 16 has first been guided through both rings 7, 8 and then folded back and guided through the first of the two rings 7 on the shoulder strap 5 again. The adaptation of the accommodating space 3 to the body measurements of the small child 2 is carried out by pulling on the end area 13 protruding from the rings 7, 8. The end area 13 is movably clamped by the rings 7, 8 and hangs down in this embodiment example.

Figure 12:
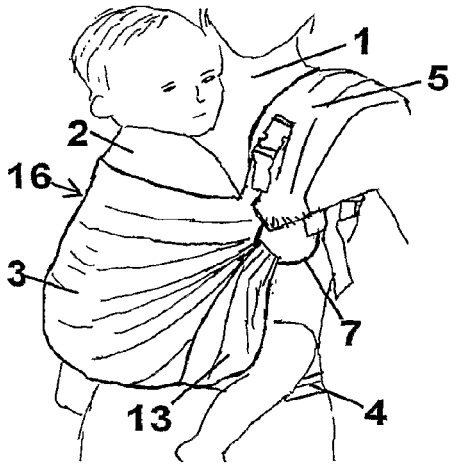
FIG. 12 shows a further embodiment, wherein here the end areas have been guided through only one ring.
Figure 20:
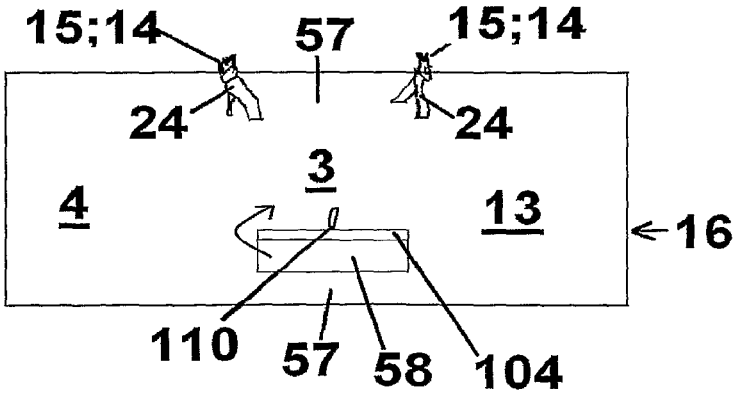
FIG. 20 shows an embodiment of an accommodating element of the carrying device according to the invention.

FIG. 12 shows a further embodiment example. Here the end areas 13, 4 of the accommodating element 16 have in each case been guided through only one ring 7 on the shoulder straps 5 and under the bottom of the small child 2, wherein the end areas 13, 4 cross over and pass through the loop 110 (FIG. 20). The end areas 13, 4 have furthermore been guided around the hips of the carrier 1 and connected together by means of knots on the carrier's back (not visible here). The accommodating space 3 is adapted to the body measurements of the accommodated small child 2 by passing the end areas 13, 4 in each case through one ring 7 on the shoulder straps 5 and pulling on the end areas 13, 4 protruding from the rings 7. By crossing over the end areas 13, 4 under the bottom of the small child 2 and tying around the hips and connecting the end areas 13, 4 by means of knots, the accommodating element 16 is then also held in this position or the adjusted wrapping of the small child 2 is held. The shoulder straps 5 are here made of a cloth-like material, which can be spread out over the shoulder of the carrier 1.

Figure 13:
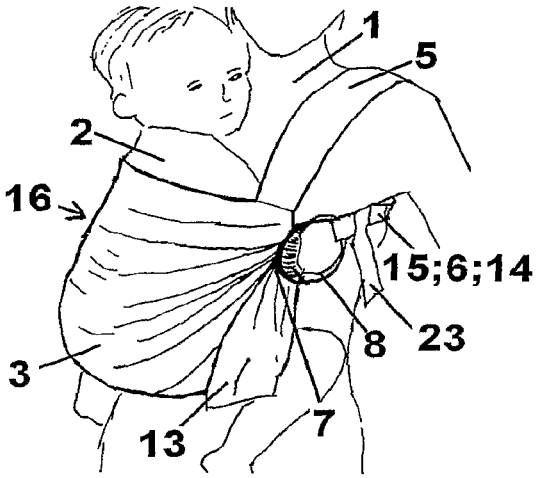
FIG. 13 shows a further embodiment, wherein here the shoulder straps are non-detachably connected to the accommodating element.

FIG. 13 shows an embodiment variant of the carrying device according to the invention, in which the accommodating element 16 is non-detachably connected to the front shoulder strap ends 5. The rings 7, 8 are connected to the strap 23 and the strap 23 to the side release buckle portion 15 and the side release buckle portion 15 to the side release buckle portion 6 positioned on the rear shoulder strap end 5, with the result that the two ends of the shoulder straps 5 are closed to form a loop by means of rings 7, 8. By means of adjustment element 14 formed in a single piece with the side release buckle 15 the strap 23 can be adapted to the body measurements of the carrier. The rings 7, 8 movably clamp the end areas 13, 4, the end areas 13, 4 hang down in this embodiment example.

Figure 14:
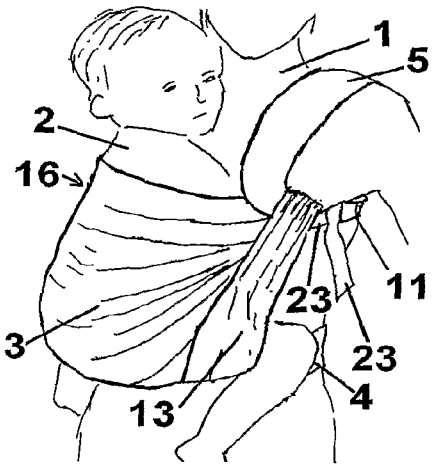
FIG. 14 shows a further embodiment, wherein here the end areas have been guided behind the shoulder straps and thus connected to the retaining harness system.

FIG. 14 shows a further embodiment example of the carrying device according to the invention. The shoulder straps 5 pass over the shoulders of the carrier 1 and form a loop: the front shoulder strap end 5, here concealed by the end area 13, is connected to the strap 23, the strap 23 to the adjustment element 11 and the adjustment element 11 to the rear shoulder strap end 5. The adaptation of the strap 23 to the body measurements of the carrier 1 is carried out by means of adjustment element 11. The end areas 13 and 4 of the accommodating element 16 have been guided behind the shoulder straps 5, crossing over (not visible here) under the bottom of the small child 2, around the hips of the carrier 1 and connected to each other by means of knots on the back of the carrier 1, not visible here. The accommodating space 3 is precisely adapted to the body measurements of the small child 2 by guiding the end areas 4, 13 behind the shoulder straps 5 and pulling on the end areas 13, 4 protruding beyond the shoulder straps 5. By connecting the end areas 13, 4 by means of knots the accommodating space 3 is held in this position adapted to the body measurements of the small child 2. It is also possible for only one end area 13 or 4 to be adjustably connected to a shoulder strap 5.

Figure 15:
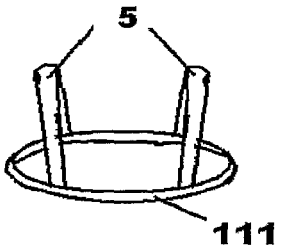
FIG. 15 shows an embodiment of the retaining harness system.

FIG. 15 shows a design of a retaining harness system: both the front and the rear shoulder strap ends 5 are connected to the connecting strap 111. If the retaining harness system is put on, the shoulder straps 5 each pass over one shoulder of the carrier, the connecting strap 111 around the chest or around the stomach of the carrier. According to one design the connecting strap 111 and the shoulder straps 5 can be adaptable to the body measurements of the carrier and/or designed to open and to close. According to one design the connecting strap 111 can be slidable on the shoulder straps 5. An accommodating element can be connected to the retaining harness system: between the front shoulder strap ends 5, between the rear and front shoulder strap ends 5, between the rear shoulder strap ends 5 and/or to the shoulder straps 5. If connection elements are provided for connecting the accommodating element 16 to the retaining harness system, these can be adjustably positioned on the retaining harness system.

Figure 16:
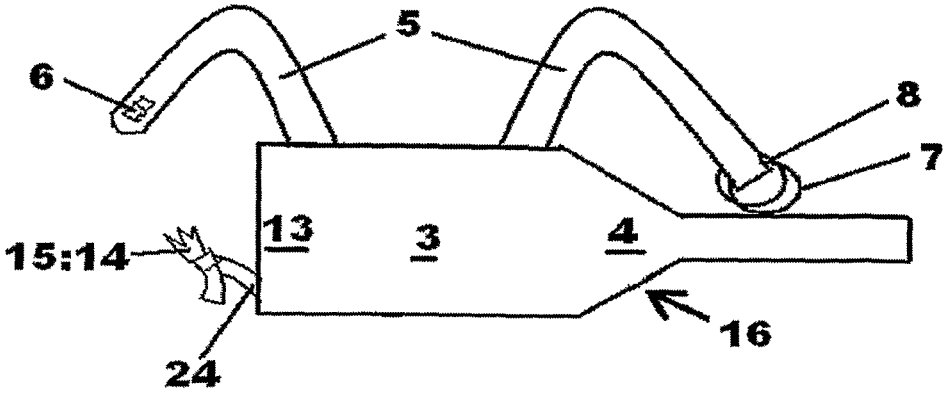
FIG. 16 shows a further embodiment of the carrying device according to the invention, in which one end area can be non-adjustably connected to the retaining harness system.

FIG. 16 shows an embodiment example in which only the end area 4 of the accommodating element 16 can be adjustably connected to the retaining harness system: if the end area 4 is guided through the rings 7, 8, folded back and then guided through the first ring 7 again, the end area 4 is movably clamped by the rings 7, 8. The end area 13 can be connected to the strap 24 positioned on the end area 13 and to the side release buckle portion 15 connected to the strap 24 with the side release buckle portion 6 positioned on the shoulder strap 5. The strap 24 can be adapted to the body measurements of the child/baby or of the carrier with an adjustment element 14 formed in a single piece with the side release buckle portion 15. The accommodating space 3 is adapted to the body measurements of the child/baby by the adjustable connection of the end area 4 with the rings 7, 8.

Figure 17:
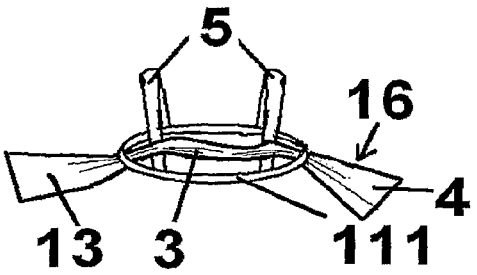
FIG. 17 shows a further embodiment, in which the accommodating element has been guided behind a connecting strap on the retaining harness system.

FIG. 17 shows a further embodiment of the present invention: the end areas 13, 4 have here been guided passing in front of the shoulder straps and behind the connecting strap 111. By pulling on the end areas 4, 13 protruding beyond the retaining harness system or the connecting strap 111, the accommodating space 3 can be adapted to the body measurements of the child/baby.

Figure 18:
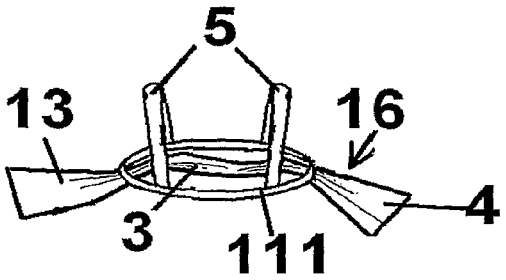
FIG. 18 shows an embodiment in which the accommodating element has been guided behind the shoulder straps and behind a connecting strap.

FIG. 18 shows a further embodiment of the present invention: the end areas 13, 4 have been guided behind the shoulder straps 5 and behind the connecting strap 111. By pulling on the end areas 4, 13 protruding beyond the retaining harness system or the connecting strap 111 and the shoulder straps 5, the accommodating space 3 can be adapted to the body measurements of the child/baby.

Figure 19:
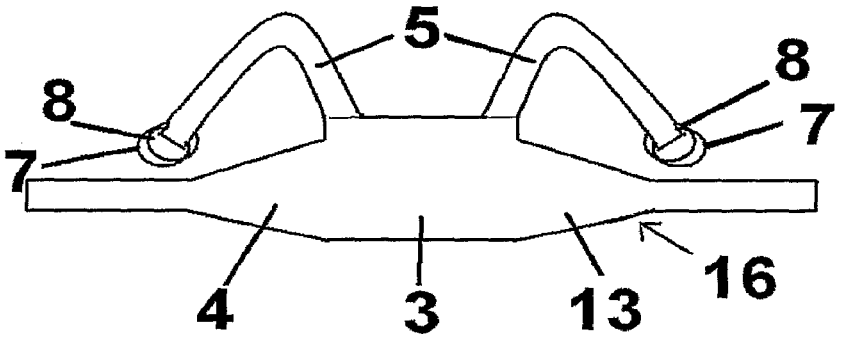
FIG. 19 shows a further embodiment of the carrying device according to the invention.

FIG. 19 shows a further embodiment of the carrying device according to the invention. The rings 7, 8 (not visible here) are adjustably positioned on the shoulder straps 5. If the end areas 4, 13 are in each case guided through the rings 7, 8, folded back and guided through the first of the two rings 7 again, the accommodating space 3 can be adapted precisely to the body measurements of the accommodated child/baby by pulling on the end areas 4, 13 protruding from the rings 7, 8. In this embodiment example the end areas 4, 13 are narrower than the accommodating space 3.

FIG. 20 shows an embodiment of an accommodating element 16. The straps 24 are positioned on the accommodating element 16 and can be connected to a retaining harness system by means of the side release buckle portion 15 connected to the strap 24 and be adapted to the body measurements of the small child/baby by means of adjustment element 14 formed in a single piece with the side release buckle portion 15. The end areas 13, 4 can be adjustably connected to a retaining harness system. The tab 58 is connected to the accommodating element 16 in the fastening area 104. Except for the fastening area 104, the tab 58 can be folded over. On the back of the tab 58, not visible here, there is a Velcro strip which can be connected to a Velcro strip on a hip belt system, wherein the hip belt can be closed around the hips of the carrier, such that the tab 58 with the side visible here without a Velcro strip is located against the body of the carrier. The positioning of the tab 58 and of the straps 24 on the accommodating element 16 results in surplus areas 57 at the top and bottom of the accommodating space 3. If the end areas 4, 13 are connected to the retaining harness system, the surplus areas 57 can be folded together and as a result the accommodating space 3 is less wide than the end areas 4, 13. If the small child is carried without a hip belt system, as shown for instance in FIG. 12, the small child sits on the tab 58. The end areas 13, 4 can, after connection to the shoulder straps or connection elements, be guided through the loop 110, wherein the end areas 13, 4 cross over and can subsequently be tied under the legs and around the hips of the carrier and can be connected by means of knots. The child is thereby prevented from slipping downwards out of the carrying device.

The present invention is not limited to the described embodiment examples. All the described characteristics, features and advantages which are apparent in particular from the description, the drawings and the claims, including spatial arrangements, design details and particulars and procedural steps and sequences, can be essential to the invention and significant, both as they are and in various combinations, modifications and variations.

The invention claimed is:

1. A carrying device for a baby or small child, comprising:

a retaining harness system and an accommodating element adjustably connected to said retaining harness system;

said accommodating element defining an accommodating space for accommodating the baby or small child to be carried, the accommodating space being adjustable to adapt to a size of the baby or small child;

said accommodating element having end regions for connection to said retaining harness system and having a lower edge;

said retaining harness system having two adjustable shoulder straps that are adaptable to a size of a carrier independently of an adapting adjustment of the accommodating space;

a hip belt disposed at a spacing distance from said lower edge of said accommodating element and connected to said accommodating element, said hip belt being adjustable to adapt to the size of the carrier; and said accommodating element having a foldable edge region below a connection thereof to said hip belt for supporting the baby or small child up to a back of its knees.

2. The carrying device according to claim 1, wherein said hip belt is releasably attached to said accommodating element.

3. The carrying device according to claim 1, wherein said hip belt is padded or reinforced.

4. The carrying device according to claim 1, wherein said accommodating element is formed as a carrying cloth in form of an embracing carrier evenly supporting the baby or small child and said accommodating element having two end regions that project beyond said retaining harness system, and wherein a change in a projecting length of each of said end regions adjusts a volume of the accommodating space.

5. The carrying device according to claim 4, wherein said two end regions that project beyond said retaining harness system are connected with one another outside the connection thereof with said retaining harness system.

6. The carrying device according to claim 1, wherein at least one connection adjustably connecting said accommodating element to said retaining harness system is formed by a pair of rings through which at least one end region of said accommodating element is guided and movably clamped.

7. The carrying device according to claim 1, wherein said accommodating element is formed of two, mutually connected parts.

* * * * *